US010003165B1

(12) United States Patent
Johnson et al.

(10) Patent No.: US 10,003,165 B1
(45) Date of Patent: Jun. 19, 2018

(54) PHOTO-ELECTRIC RECEPTACLE LUMINAIRE INTEGRATION POINT

(71) Applicant: GE Lighting Solutions, LLC, East Cleveland, OH (US)

(72) Inventors: David Mark Johnson, Hendersonville, NC (US); Matthew S. Mrakovich, East Cleveland, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 0 days. days.

(21) Appl. No.: 15/434,166

(22) Filed: Feb. 16, 2017

(51) Int. Cl.

| | |
|---|---|
| ***H01R 4/50*** | (2006.01) |
| ***H01R 33/945*** | (2006.01) |
| ***H01R 13/66*** | (2006.01) |
| ***F21V 23/00*** | (2015.01) |
| ***F21V 27/02*** | (2006.01) |
| ***F21V 23/02*** | (2006.01) |
| *F21V 23/04* | (2006.01) |
| *F21W 131/10* | (2006.01) |

(52) U.S. Cl.
CPC ..... *H01R 33/9453* (2013.01); *F21V 23/001* (2013.01); *F21V 23/02* (2013.01); *F21V 27/02* (2013.01); *H01R 13/6675* (2013.01); *F21V 23/0464* (2013.01); *F21W 2131/10* (2013.01)

(58) Field of Classification Search
CPC .... F21V 23/001; F21V 23/02; F21V 23/0464; H01R 13/6271; H01R 33/94
See application file for complete search history.

(56) References Cited

U.S. PATENT DOCUMENTS

| | | | | |
|---|---|---|---|---|
| 7,637,766 | B2 * | 12/2009 | Kauffman | G01J 1/02 439/337 |
| 8,398,435 | B2 * | 3/2013 | Aurongzeb | H01R 13/625 439/607.41 |
| 8,864,514 | B2 * | 10/2014 | Ilyes | G08C 19/00 439/337 |
| 9,347,822 | B2 * | 5/2016 | Mostoller | H05B 37/0218 |
| 2012/0139426 | A1 * | 6/2012 | Ilyes | F21V 23/02 315/152 |

* cited by examiner

*Primary Examiner* — Xuong Chung Trans
(74) *Attorney, Agent, or Firm* — Peter T. DiMauro; GE Global Patent Operation

(57) ABSTRACT

Provided is a receptacle for installation within a lighting fixture. The receptacle includes a platform (i) for exposure external to the lighting fixture and (ii) providing connectivity for coupling to an external control device and a base operationally coupled to the platform and including a first set of one or more nodes configured for coupling to a first set of wires.

11 Claims, 8 Drawing Sheets

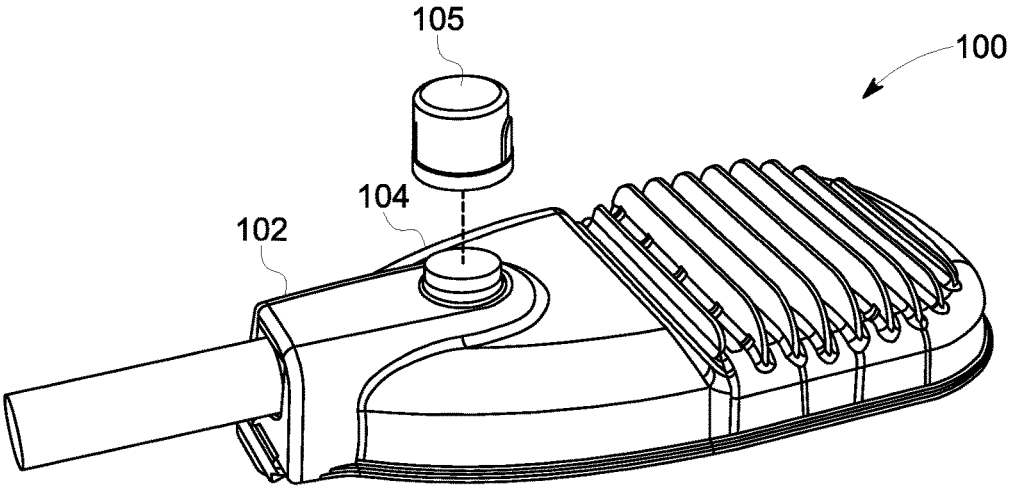
FIG. 1
(CONVENTIONAL)
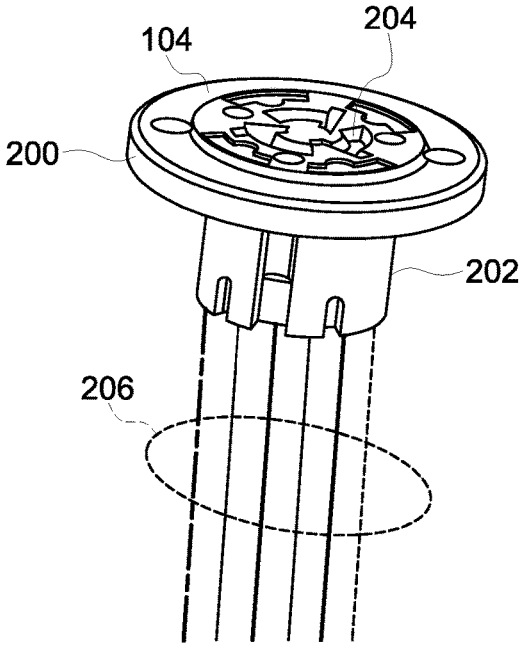
FIG. 2
(CONVENTIONAL)

PHOTO-ELECTRIC RECEPTACLE LUMINAIRE INTEGRATION POINT

I. TECHNICAL FIELD

The present invention relates generally to providing wiring for luminaires. More specifically, the present invention relates to reducing the complexity in the wiring of light emitting diode (LED) luminaires.

II. BACKGROUND

Many factors are driving the global demand for LED lighting solutions. This increased demand has triggered an expansion of LED applications and utilization. The energy and cost savings alone have particularly broadened the utility of LEDs in industrial applications. Correspondingly, the complexity of LED based lighting systems, such as high-power LED luminaires, has also increased.

High-power LED luminaires, such as those used in outdoor applications, are available in many different configurations, based on the underlying requirements and applications. These configurations include numerous subsystems, with wiring subsystems being one type. Although the requirements, applications, and configurations may differ, many of the internal connection points, associated with the wiring subsystem, are the same or similar. Unfortunately, these similarities have failed to produce lighting fixture structured internal wiring techniques.

The absence of LED luminaire structured wiring standards increases the likelihood of mistakes, and accordingly, increased installation and maintenance costs, particularly in outdoor luminaires. For example, many of the same connection points are mounted in different locations and accomplished using completely different connector wires, screws, and nuts.

By way of background, many outdoor luminaires have external receptacles for mounting of photoelectric (PE) controls. Traditionally, a PE receptacle includes power connections for a PE controller which detects when ambient light levels are low enough to turn on or the luminaire. In addition to providing power connections and lighting control, the industry is moving toward the receptacle/PE also including connections for various low voltage signals. The receptacle and photo-control, is often rotatable 360 degrees to enable aiming the photo-control to point north, the preferred direction for sensing day and night while protecting the PE sensor from direct sun light.

One conventional approach to simplify wiring connection wiring is to use a standardized harness. The use of standardized harnesses can be complicated because of variations from one stock keeping unit (SKU) to another SKU, while only marginally reducing the probability of mistakes. On the other hand, harnesses can create the need for additional wires not routinely used, thus actually increasing the overall complexity. These tradeoffs ultimately render this approach suboptimal.

III. SUMMARY

Given the aforementioned deficiencies, a need exists for methods and systems for standardizing wiring solutions to aid the reduction of wiring errors in LED luminaires. A need also exists for methods and systems to reduce assembly time, the number of wire connections, and place the connections in one location.

Embodiments of the present invention provide a unique integrating system, including a PE receptacle, for standardizing wiring connection points within an LED luminaire. This integrated PE receptacle solution can simplify installation, modifications, and maintenance of LED luminaires. The Illustrious embodiments provide a standardized integrating point, along with more easily understood wiring arrangements to reduce labor costs.

Under certain circumstances, an embodiment of the present invention includes a photo electric (PE) receptacle for installation within an outdoor luminaire. The PE receptacle includes a platform (i) for exposure external to the lighting fixture and (ii) configured to provide connectivity to an external control device and a base operationally coupled to the platform and including a first set of one or more nodes configured for coupling to a first set of wires.

Additional features, modes of operations, advantages, and other aspects of various embodiments are described below with reference to the accompanying drawings. It is noted that the present disclosure is not limited to the specific embodiments described herein. These embodiments are presented for illustrative purposes only. Additional embodiments, or modifications of the embodiments disclosed, will be readily apparent to persons skilled in the relevant art(s) based on the teachings provided.

IV. BRIEF DESCRIPTION OF THE DRAWINGS

Illustrative embodiments may take form in various components and arrangements of components. Illustrative embodiments are shown in the accompanying drawings, throughout which like reference numerals may indicate corresponding or similar parts in the various drawings. The drawings are only for purposes of illustrating the embodiments and are not to be construed as limiting the disclosure. Given the following enabling description of the drawings, the novel aspects of the present disclosure should become evident to a person of ordinary skill in the relevant art(s).

FIG. 1 is an illustration of a conventional luminaire assembly including a standard PE receptacle and PE control device.

FIG. 2 is a more detailed illustration of the standard PE receptacle depicted in the illustration of FIG. 1.

V. DETAILED DESCRIPTION

Figure 3:
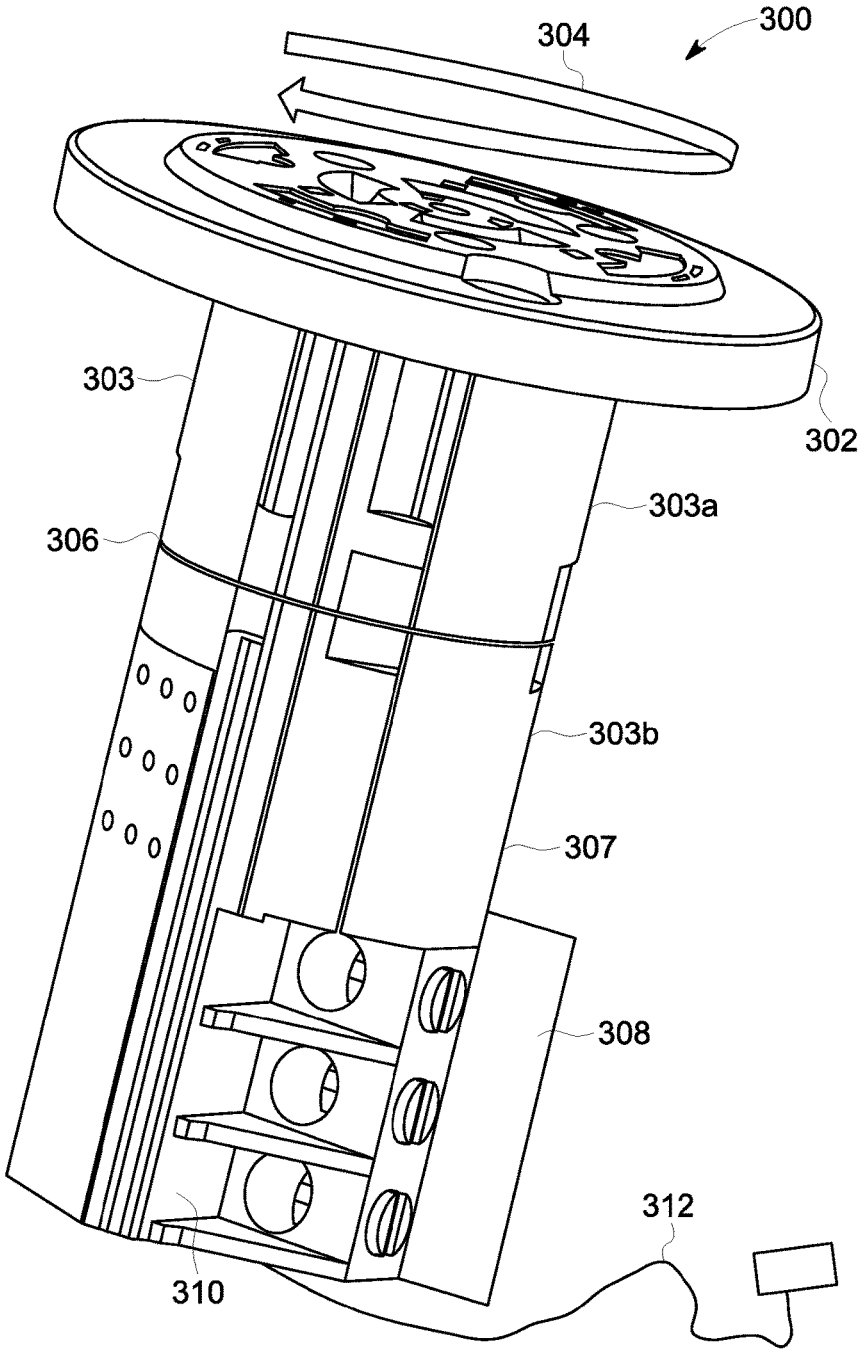
FIG. 3 is an illustration of an exemplary PE receptacle having an integrated platform in accordance with an embodiment of the present invention.

While the illustrative embodiments are described herein for particular applications, it should be understood that the present disclosure is not limited thereto. Those skilled in the art and with access to the teachings provided herein will recognize additional applications, modifications, and embodiments within the scope thereof and additional fields in which the present disclosure would be of significant utility.

FIG. 1 is an illustration of a lighting fixture 100, such as an LED luminaire assembly, including a luminaire surface (enclosure) 102, a conventional PE receptacle 104 installed within the luminaire 102 and a PE controller 105. The conventional PE receptacle 104 is configured for coupling with the PE controller 105 to the lighting fixture 100. The PE controller 105 detects when the ambient light levels are low enough to activate lighting sources within the LED luminaire 100.

FIG. 2 is a more detailed illustration of the conventional PE receptacle 104 depicted in FIG. 1. The PE receptacle 104 includes a top portion (i.e., Platform) 200 coupled to a bottom portion (i.e., a base) 202. When installed, the platform 200 extends above the luminaire surface 102 and enables power leads 204 for coupling to the PE sensor (not shown) to facilitate photoelectric control.

The base 202 is configured for in insertion into the LED luminaire 100. As depicted in FIG. 2, a number of wires 206 are provided for accommodating additional electrical signals. The PE receptacle 100, however, is limited in the types of signals it can efficiently accommodate.

FIG. 3 is an illustration of an exemplary integrated PE receptacle 300 constructed in accordance with an embodiment of the present invention. Unlike the conventional PE receptacle 104, the PE receptacle 300 is a single integrating point for all wiring connections in the electrical compartment of the luminaire. Having a single integrating point for all wiring connections provides simplicity in the wiring solution.

By way of example, and not limitation, the PE receptacle 300 can serve as a single location supporting wiring for wireless connectivity, a customer controller signals and supply power line connections (L1), line 2 (L2), neutral (N)), PE control power (red), grounding, fuses, transient voltage surge suppression (TVSS), along other internal connections.

The PE receptacle 300 includes a platform 302 and a base 303 for insertion within an exemplary LED luminaire, such as the luminaire 100. As depicted in FIG. 3, the platform 302 is twistable in a rotational direction 304 to provide photoelectric control. For example, as understood by those of skill in the art, PE sensors are typically oriented, during installation, to avoid being aimed directly at the sun. This process helps prevent over saturation, and damage, of the PE sensor. The platform would need rotational capabilities up to approximately 360 degrees. Stops are often provided to limit the platform rotation beyond approximately 360 degrees.

Accordingly, the platform 302 of the PE receptacle 300 can be twisted, during installation, for pointing in a northern or optimal direction. The PE receptacle 300 includes a break (e.g., joint) 306 for rotatably connecting an upper portion 303*a* of the base 303 to a lower portion 303*b*. The break 306, which could be positioned in a number of locations within the PE receptacle 300, is positioned within the luminaire 100.

Positioning the PE receptacle 300 base within luminaire 100 provides shielding from elements of the environment. During twisting of the upper portion 303*a*, the lower portion 303*b* remains stationary.

The PE receptacle 300 also includes an optional fuse terminal 307 for attaching fuse wiring and an optional snap-on TVSS terminal 308 for attaching TVSS wiring or TVSS module. The PE receptacle 300 includes power connection terminals (i.e. nodes) 310, and a ground wire 312 for any required grounding of the luminaire.

Figure 4:
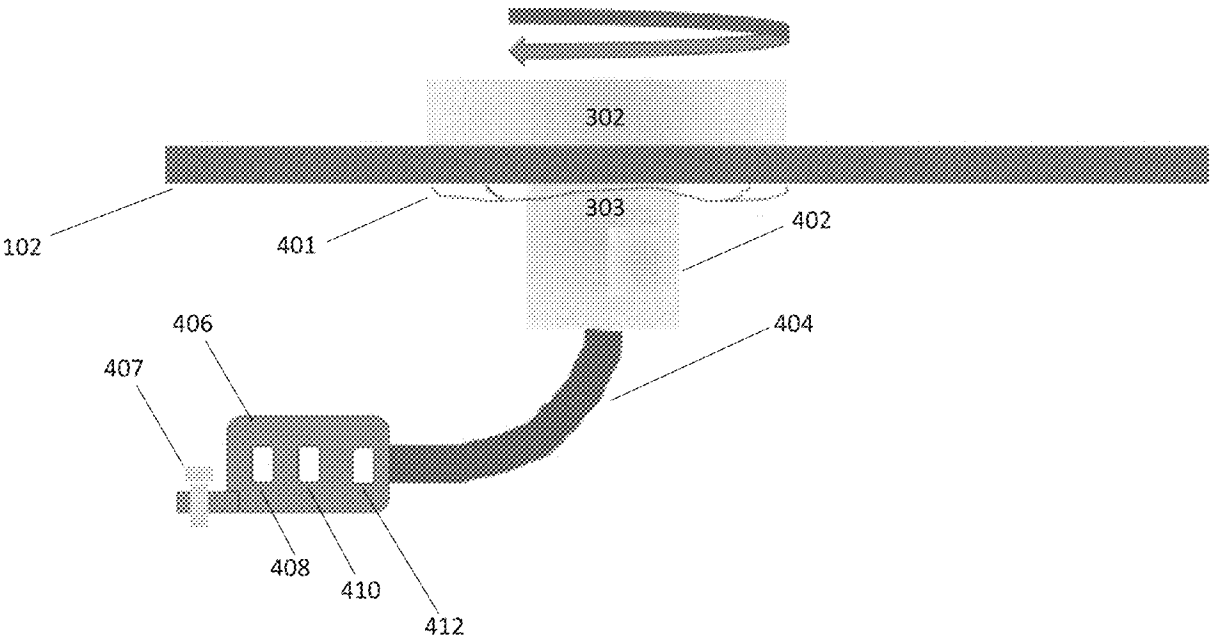
FIG. 4 is an illustration of the exemplary PE receptacle of FIG. 3 connected to a terminal board via a flexible cable, in accordance with the embodiments.

FIG. 4 is an illustration of the exemplary PE receptacle 300 of FIG. 3 connected to the terminal block via a flexible cable. In FIG. 4, the PE receptacle 300 is depicted showing the platform 302 extending above the luminaire surface 102 and the base 303, remaining below the surface 102. The view depicted below the surface 102 is located within the luminaire 100. In the embodiment of FIG. 4, the receptacle 300 can be snapped into place, within the luminaire 100, via an exemplary fastener, such as a mounting spring 401.

By way of example, the embodiment depicted in FIG. 4 can include connections points (i.e. nodes) 402 affixed to the base 303. The connection points 402 can connect wiring for a digital addressable lighting interface (DALI), drivers, etc. An integral flexible cable 404 can be provided as wiring for L1, L2/N, functionality. The flexible cable 404 can be connected to a terminal board 406, which operates as an optional port for TVSS clip on, and fuses.

By way of background, L1 and L2 are essentially the power wire routed up the pole to provide power to the luminaire 100. As such, this wiring can be relatively stiff, rigid and would generally not rotate with the platform 302. Therefore, the flexible cable 404 is a type of a jumper (e.g., flexible coupling) connecting the terminal board 406 to a device—permitting the platform 302 to twist or move.

As noted above, in the embodiment of FIG. 4, the platform 302 is twistable/movable. Correspondingly, the connection points 402 are also twistable/movable. The terminal board 406, however, is stationary and can include a mounting tab and ground connection port 407. The terminal board 406 also includes customer connections L1 408, ground 410, and L2/N 412.

Figure 5:
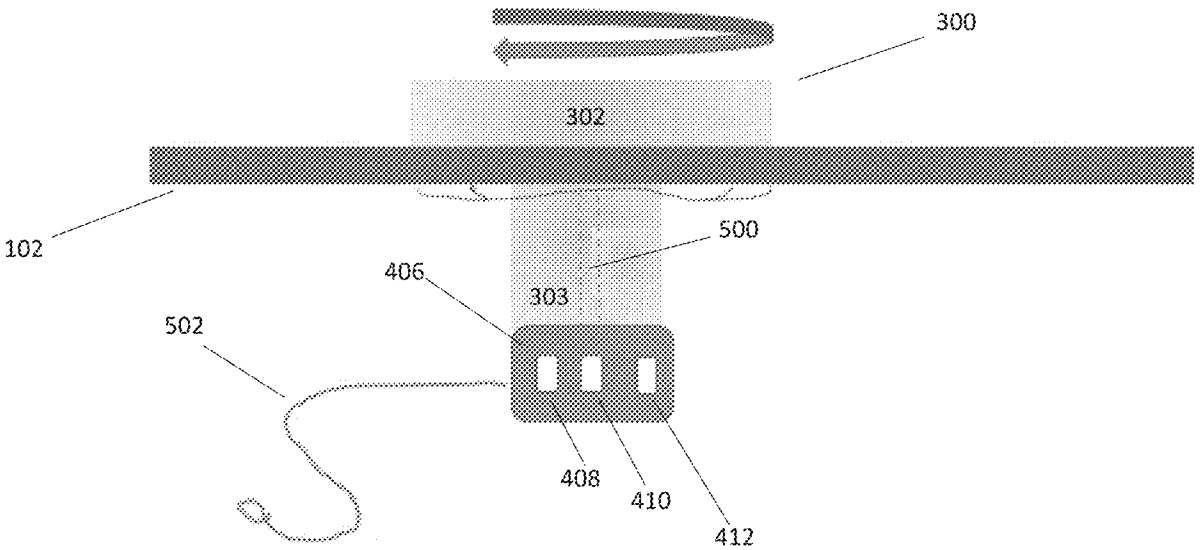
FIG. 5 is an illustration of the exemplary PE receptacle of FIG. 3 having the terminal board connected directly to the platform, in accordance with the embodiments.

FIG. 5 is an illustration of the exemplary PE receptacle 300 of FIG. 3 having the terminal block 406 connected at the bottom of the base 303 via one or more slip rings (shown in FIG. 6), in accordance with the embodiments. By removing the flexible cable 404 and affixing the terminal board 406 to a bottom of the base 303, the platform 302 is provided with an even higher degree of movement.

In the exemplary embodiment of FIG. 5, the customer connections L1 408, ground 410, and L2/N 412 are depicted in a horizontal fashion. The embodiments, however, are not so limited. That is, the connections L1 408, ground 410, and L2/N 412 could be positioned vertically, or in other suitable arrangements. Wires associated with L1 and L2/N are routed through a centerline 500 within the receptacle 300, between the terminal board 406 and the platform 302. This process increases ability of the platform 302 to twist in comparison to the embodiment of FIG. 4. A wire 502 is provided for connecting the terminal board 406 to ground.

Figure 6:
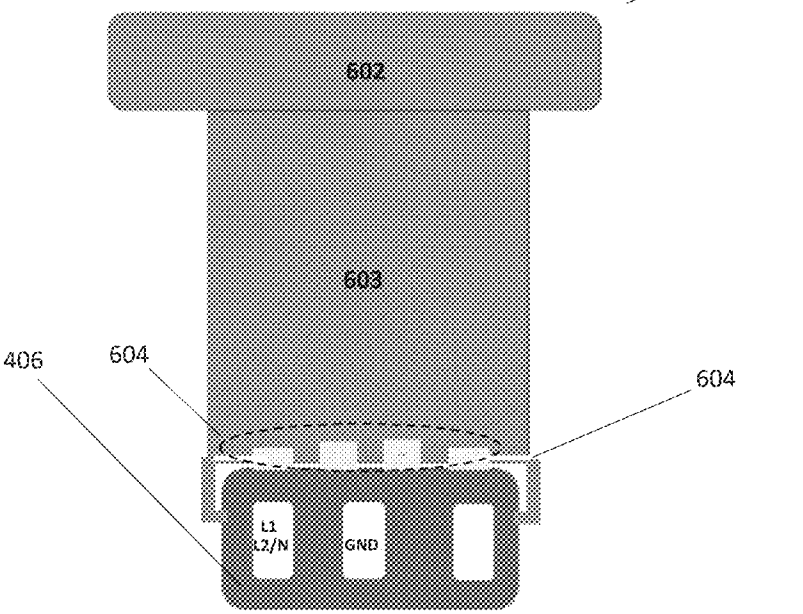
FIG. 6 is an illustration of an exemplary PE receptacle connectable via rings and springs, in accordance with the embodiments.

FIG. 6 is an illustration of the exemplary PE receptacle 600, in accordance with the embodiments. The receptacle 600 includes a platform 602 and a base 603. In FIG. 6, the PE receptacle 600 includes a break 604 near a bottom of the base 603. The terminal board 406 is connected to the platform 602 through rings and springs 604. The rings and springs 604 permit twisting of the bottom portion of the base 603 while the terminal board 406 remains stationary. The receptacle 600 is configured for being pushed through an opening at the top of the luminaire 100. After insertion, the receptacle 600 can be held in place via a fastener, such as a spring clip.

Figure 7:
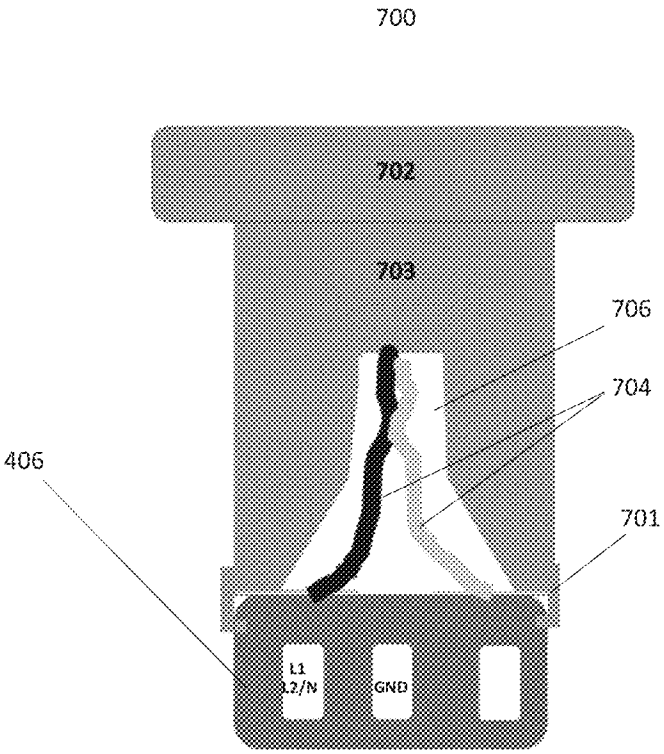
FIG. 7 is an illustration of an exemplary PE receptacle connectable via snaps, in accordance with the embodiments.

FIG. 7 is an illustration of an exemplary PE receptacle 700 connectable via snaps 701, in accordance with an alternative embodiment. The receptacle 700 includes a platform 702 and a base 703. In FIG. 7, the terminal block 406 snaps on outside of the receptacle 700 to enable wires 704 to run through centerline 706 and twist. The control connections remain within the terminal board 406.

Figure 8:
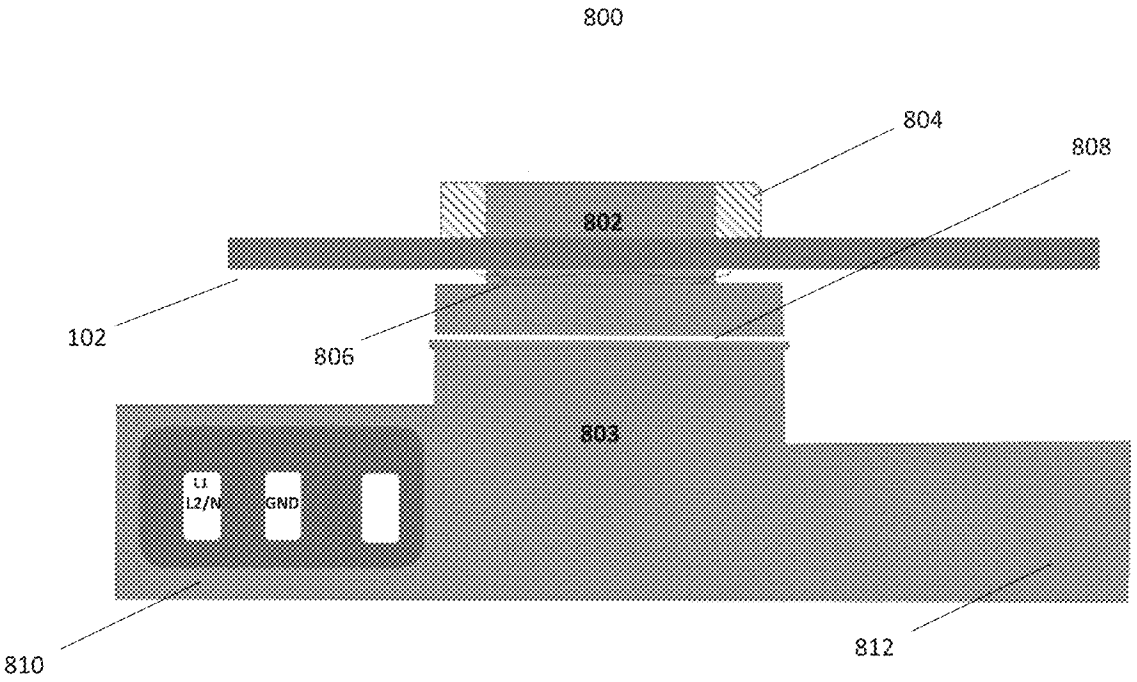
FIG. 8 is an illustration of an exemplary PE receptacle depicting signal and power separation.

FIG. 8 is an illustration of an exemplary PE receptacle 800 (i.e., a connection block), in accordance with yet another embodiment of the present invention. In some situations, it might be desirable to snap on a larger connection block, that may not be able to fit through the opening in the luminaire 100.

In FIG. 8, the receptacle 800 includes a platform 802 and a base 803. The receptacle 800 is configured to be pushed from within the luminaire 100, through the opening, to the outside. Once the platform 802 of the receptacle 800 pushes through the opening, it can be locked to the luminaire 100 via a snap ring 804 on the exterior side of the luminaire surface 102. A spring clamp 806, on an interior side of the surface 102, not only locks the platform 802 in place, but in conjunction with a break 808, permits twisting thereof.

The receptacle 800 can also be partitioned into separate a power segment 810 and a signal segment 812. The power segment 810 includes customer connections (signals line 1 (L1), line 2 (L2), neutral (N)). The signal segment 812 includes connections points for driver, DALI, 0-10V, and other wiring. This approach would allow for a larger base that is not constrained by the hole size in the top of the luminaire surface 102.

Figure 9:
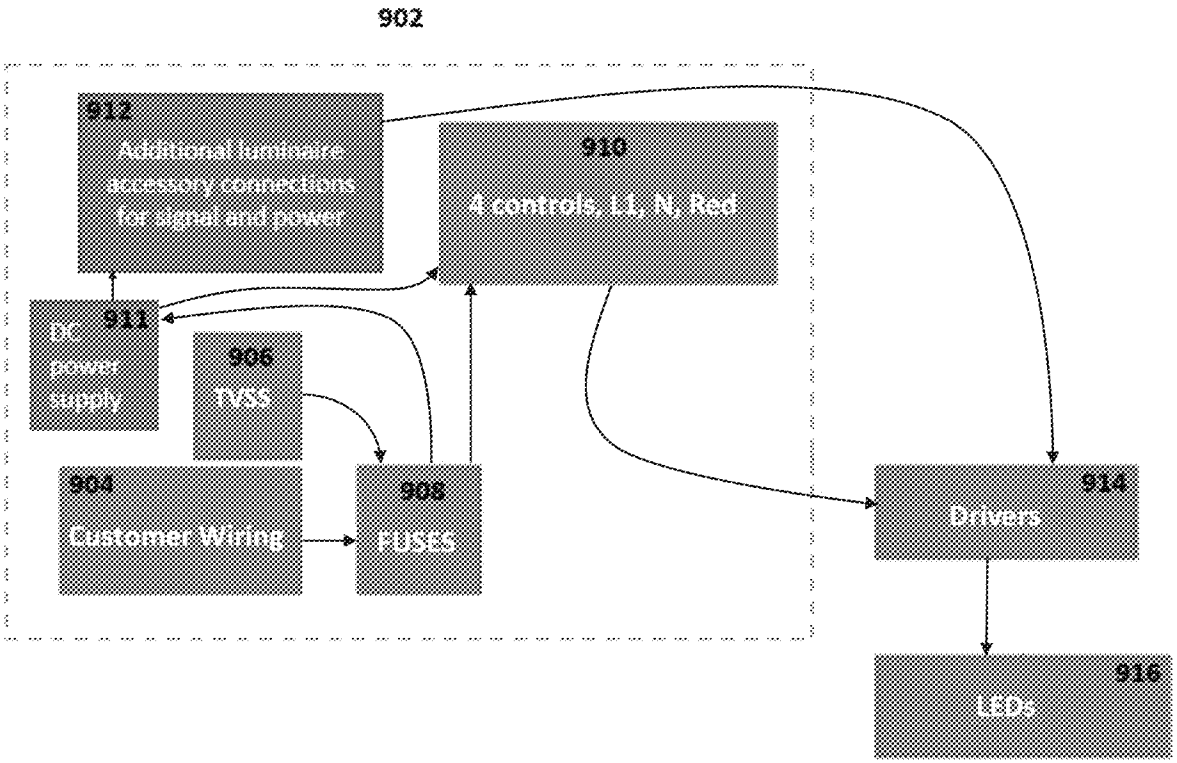
FIG. 9 is a block diagram illustration depicting exemplary connections for pre-wiring into an LED luminaire constructed in accordance with the embodiments.

FIG. 9 is an illustration of a block diagram 900 depicting exemplary connections for pre-wiring into an LED luminaire constructed in accordance with the embodiments. Embodiments of the present invention provide a larger pre-wired connection block to allow for greater separation of circuits.

In FIG. 9, the exemplary block diagram 900 depicts connections for delivery pre-wired within the luminaire 100. The embodiments provide a single integrating point for customer wiring, TVSS, fuses, signaling, etc. For example, block 902 includes a sample of the modules, such as customer wiring 904, TVSS 906, fuses 908, and customer controls 910, that could be included in an integrated receptacle, such as the receptacle 800.

Additionally, a small direct current (DC) power supply 911, such as an alternating current (AC) to DC power supply 911, can be added. The power supply 911, integral to the receptacle, provides power to accessories via accessory connections 912. For example, accessories such as motion sensors, occupancy sensors, or other external controls, can connect both power and control wiring to a base, such as the base 803.

By way of example, wires associated with the module 910 can include a red wire, L1, the neutral (N) wire, and the 4 control wires. Wires from the module 910 can connect to the drivers 914. In some embodiments, one or more wires extend from the drivers 914 for connecting to, and providing constant current to, an LED circuit board 916.

Alternative embodiments, examples, and modifications which would still be encompassed by the disclosure may be made by those skilled in the art, particularly in light of the foregoing teachings. Further, it should be understood that the terminology used to describe the disclosure in intended to be in the nature of words of description rather than of limitation.

Those skilled in the relevant art(s) will appreciate that various adaptations and modifications of the embodiments described above can be configured without departing from the scope and spirit of the disclosure. Therefore, it is to be understood that, within the scope of the appended claims, the disclosure may be practiced other than as specifically described herein.

What is claimed is:

1. A receptacle for installation within a lighting fixture, the receptacle configured for coupling to a photo electric controller and comprising:

a platform (i) for exposure external to the lighting fixture and (ii) configured to provide connectivity to a photo electric controller; and a base operationally coupled to the platform and including an upper portion of the base, a lower portion of the base, and a joint for rotatably connecting the upper portion to the lower portion, wherein the platform can be twisted while the lower portion of the base remains stationary.

2. The receptacle of claim 1, wherein a terminal board is coupled to the base via at least one from the group including a flexible cable and direct connection.

3. The receptacle of claim 1, wherein the lighting fixture is configured for outdoor operation.

4. The receptacle of claim 1, wherein the receptacle is a photo electric (PE) connection device.

5. The receptacle of claim 1, wherein the lighting fixture is an LED luminaire.

6. The receptacle of claim 1, further comprising an AC to DC power supply configured to provide power to accessories.

7. A photo electric (PE) receptacle for installation within an outdoor light emitting diode luminaire, comprising:

a platform (i) for exposure external to the lighting fixture and (ii) configured to provide connectivity to an external control device; and a base operationally coupled to the platform and including an upper portion of the base, a lower portion of the base, and a break or joint for rotatably connecting the upper portion to the lower portion, wherein the platform can be twisted while the lower portion of the base remains stationary.

8. The receptacle of claim 7, further comprising a terminal board.

9. The receptacle of claim 8, wherein the terminal board is coupled to the base via at least one from the group including a flexible cable and direct connection.

10. The receptacle of claim 7, wherein the receptacle is a photo electric (PE) connection device.

11. The receptacle of claim 7, further comprising an AC to DC power supply configured to provide power to accessories.

* * * * *